US006063528A

United States Patent [19]

Morgan

[11] Patent Number: 6,063,528

[45] Date of Patent: May 16, 2000

[54] THERMOSENSITIVE COMPOSITION

[76] Inventor: David A. Morgan, 13780 N. Manning Trail, Stillwater, Minn. 55144-1000

[21] Appl. No.: 08/859,681

[22] Filed: May 20, 1997

[51] Int. Cl.[7] ..... G03C 3/00

[52] U.S. Cl. ..... 430/9; 430/270.1

[58] Field of Search ..... 430/9, 270.1

[56] References Cited

U.S. PATENT DOCUMENTS

| | | | |
|---|---|---|---|
| 2,760,431 | 8/1956 | Beatty | 101/149.2 |
| 3,103,881 | 9/1963 | Grieshaber | 101/149.2 |
| 3,156,183 | 11/1964 | Bach | 101/149.2 |
| 3,168,864 | 2/1965 | Branal et al. | 101/149.2 |
| 3,700,458 | 10/1972 | Lindholm | 96/114.1 |
| 4,081,572 | 3/1978 | Pacansky | 427/53 |
| 4,210,711 | 7/1980 | Kitajima et al. | 430/325 |
| 4,725,534 | 2/1988 | Kagami et al. | 430/619 |
| 5,025,266 | 6/1991 | Shimamura et al. | 346/1.1 |
| 5,328,811 | 7/1994 | Brestel | 430/325 |
| 5,512,418 | 4/1996 | Sheau-Hwa Ma | 430/271.1 |
| 5,533,452 | 7/1996 | Mouri et al. | 430/302 |
| 5,569,573 | 10/1996 | Takahashi et al. | 430/138 |
| 5,663,032 | 9/1997 | Fukui et al. | 430/281.1 |

FOREIGN PATENT DOCUMENTS 0 763 425 3/1997 European Pat. Off. .

OTHER PUBLICATIONS

Translation of: "*Bridges of Ions in Macro Molecular Networks*" By Hans J. Kuhn and W. Gerhard Pohl, Item 923, Helvetica Chimica Acta, (1965).

Data Sheet of Creo Products Inc. Trendsetter®, Model 3244 Thermal Plate Setter (1995).

Data Sheet of MacDermid Metex Ultra Etch®, (May 29, 1996).

*Primary Examiner*—Maria Nuzzolillo
*Assistant Examiner*—Laura Weiner
*Attorney, Agent, or Firm*—Steven G. Lisa; William J. Hallihan

[57] ABSTRACT

A thermosensitive composition consisting of a mixture of polyacrylic acid, a salt of a long chain fatty acid such as silver behenate, an infra-red absorbent and modifiers such as additional polymers and fillers. Both the water solubility and affinity to water and oil are changed when composition is heated.

27 Claims, No Drawings

THERMOSENSITIVE COMPOSITION

FIELD OF INVENTION

The invention relates to thermally alterable compositions and more specifically to coatings which can be switched imagewise from hydrophilic state to a hydrophobic state using a focused infra-red (IR) laser. The main application is lithographic printing masters.

BACKGROUND OF THE INVENTION

A chemical composition capable of switching from a hydrophilic state to a hydrophobic state when heated, preferably by a focused IR laser, has been discovered. Same composition also changes from a water soluble to an insoluble composition when heated. The degree of solubility and the degree of hydrophilic activity can be controlled over a wide range by mixing the composition with different polymers. Such compositions are of great commercial importance in the field of lithographic offset printing, which is based on the fact that the hydrophilic areas of an image will not carry ink. The making of lithographic printing masters is well known, however most lithographic masters require processing after exposure. The current invention allows lithographic masters, such as printing plates, to be used immediately after exposure without requiring any chemical development. The invention also enables the use of the composition to coat printing cylinders directly and image them on the printing press. Prior art thermosensitive composition based on physical effects (melting) or different reactions do not produce as sharp a switch of properties as the present invention. In this disclosure the term "water solubility" refers not only to true solubility, but to the ability to be washed away by water or water-based solutions, even if the removal mechanism is based on effects other than true solubility. Effects such as softening, swelling, lifting, and others are included in the term "solubility".

BRIEF DESCRIPTION OF THE INVENTION

In accordance with the invention, a water soluble polymer is made to react with a metallic salt of a long chain fatty acid. As long as the mixture is not heated it is hydrophilic due to the water soluble polymer. After heating, the water soluble polymer reacts with the metallic salt to form a highly hydrophobic and insoluble polymer. While it is believed to be the nature of the reaction, the invention should not be constrained by any explanation used in the disclosure. In order to make the composition compatible with imagewise heating using lasers, an absorber for the specific laser wavelength used has to be added. Absorbers can be broadband (covering a wide range of wavelength) such as carbon powder or dyes tuned to a specific laser wavelength, such as IR absorbing dyes tuned to laser diodes.

In the most basic form, the invention contains only these three ingredients (water soluble polymer, salt of fatty acid, and laser absorber). In this form the unexposed areas are both hydrophilic and highly water soluble. After heating with a laser, the exposed areas become highly hydrophobic and insoluble. In this form the invention is useful for making lithographic printing plates by coating a lithographic metal, such as anodized aluminum, with the composition. The unexposed areas are washed away and the exposed metal repels ink by carrying water.

A more useful form of the invention results when additional polymers and fillers are introduced to control the solubility of the unexposed areas without degrading the basic switch from hydrophilic to hydrophobic. For example, if a sufficient amount of polyvinyl butyral is added the unexposed areas are hydrophilic but not easily soluble, thus a printing master which does not rely on lithographic metal is created. Such a printing master has major advantages for making low cost lithographic plates. It can be coated on almost any substrate including re-usable lithographic masters, as old coating can be washed off after printing, and a new coating applied without particular concern for contamination remaining on the substrate. Such materials are also known as "surface switchable polymers" or "switchable polymers". An example of such a polymer is given in U.S. Pat. No. 4,081,572.

DETAILED DESCRIPTION OF THE INVENTION

A thermosensitive composition switching from a water soluble hydrophilic state to an insoluble hydrophobic state is based on the reaction between a water soluble polymer and a metallic salt of a long chained fatty acid. The length of carbon chain of the fatty acid is critical. Short fatty acid salts are too reactive, and will react with the water soluble polymer at room temperature. Very long fatty acids will not react at all. The invention requires a composition which has a long shelf life at room temperature (up to years) while reacting in a few millionths of a second at temperatures of a few hundred degrees celsius. The requirement for a very fast reaction time at elevated temperatures stems from the need to imagewise expose a thin layer of the composition using a focused laser beam. The small size of the laser beam, typically 2–20 microns, causes the dwell time of the beam on any given spot to be extremely brief, in the range 1–10 microseconds. It was found out that only fatty acids with a carbon chain length from about 18 to 24 carbon atoms perform well. The rate of reaction at a given temperature can also be modified by the molecular weight of the water soluble polymer as well as by adding other polymers to the composition. The ratio of the ingredients also affects the rate of the reaction. These effects are secondary compared to the dominant effect of the carbon chain length of the fatty acid.

The best results were obtained by using polyacrylic acid as the water soluble polymer and silver behenate as the metallic salt of the fatty acid, with polyvinyl butyral as a modifying polymer. The modifying polymer controls the degree of water solubility of unexposed areas. The phrase "water solubility" does not only refer to solubility in pure water, but in many aqueous solutions, as long as they are not sufficiently active to change the composition. By way of example, "water solubility" in the context of printing plates should be interpreted as solubility in the water fountain solution used on a lithographic press, which contains small amounts of acid, gum, and other ingredients in the water. This phrase also refers to the solubility in aqueous developers, typically alkaline solutions. As the case is for any solvent, the solubility is also strongly affected by temperature. The uniqueness of the invention lies in the very sharp switching of the surface properties found in this reaction and the greater versatility of the reaction due to its high tolerance to additives. The high tolerance allows it to tailor the properties of the composition by adding relatively large amounts of other polymers and fillers such as clay, pigments, absorbers etc. Surfactants and adhesion promoters can be added as well without affecting the reaction. In the following examples the solvent used is ethanol, but other solvents can be used as well. The solvent fully evaporates after application of the composition, thus is not part of the reaction. Different solvents, such as ethanol/water mixes or pure water can be used. In most applications, the composition is applied by roller coating, knife coating or spraying to a thickness of 1–10 microns. In order to absorb sufficient amounts of laser power in such a thin layer, a strong absorber is required, as the composition works with all of them. The best performing absorbers for the near IR were IR dye ADS930 made by American Dye Source (N.J.); Lamplack Carbon Powder from Fisher Scientific Supplies, and WS830 from Zeneca (U.K.), which is a water soluble IR dye. In all the following examples the word "IR Absorber" should be interpreted as one of these absorbers. The invention, of course, is not limited to any absorber and works well even without an absorbent if the heat is applied directly by conduction or convention instead of by radiation. By the way of example, the composition can be used without an absorbent if it is coated onto a substrate which absorbs the laser radiation, heating up the coated layer by conduction. Another application where an absorber is not required is when the heat is applied by an array of resistive elements, similar to thermographic paper.

The composition can be coated on any substrate providing sufficient dimensional stability and adhesion. Of particular importance are lithographic printing plates created by coating the composition onto the following substrates: aluminum, steel, polyester, lithographic aluminum (which is grained and anodized aluminum), waterproof paper, and aluminum foil clad paper.

The versatility of the invention is illustrated by the following examples. As is the case for all thermosensitive compositions, it is sometimes desired to add an indicator dye that permanently changes color with temperature, to generate a visible image of the imagewise exposed areas. One manner of creating a more visible image using the present invention is the use of a reducing agent to reduce the silver behenate to metallic silver, creating a dark image of the exposed areas. Such reduction of silver behenate to produce a visible image is disclosed in U.S. Pat. Nos. 3,168,864 and 3,103,881 and need not be detailed here. Note that while these prior art compositions use silver behenate, they use it to form the visible image and not as the key for the hydrophilic to hydrophobic switching.

EXAMPLE 1A–1B

A dry sample of silver behenate is mixed with ethanol and a 7% solution of polyacrylic acid. It is ball milled for eight hours using 12 mm balls. If carbon absorber is used (example 1A), it is mixed with the above ingredients before ball milling. If an IR dye is used (example 1B), it is mixed only after ball milling due to the short shelf life of the IR dye. The quantities are as follows:

3 grams silver behenate (available from Aveka Inc. Woodbury, Minn.)

1 gram polyacrylic acid (14.3 grams of 7% solution, available from Scientific Polymer Products, N.Y.)

Note: the polyacrylic acid has a typical molecular weight of 450,000.

1 gram absorber (carbon in example 1A or ADS830 in example 1B)

24 grams ethanol

This liquid is spread on lithographic aluminum (available from any printing plate supplier, such as City Plate, N.Y.) using a knife coater to a dry thickness of about 1.5 microns. It is exposed with a Creo Products Inc. (B.C., Canada) Trendsetter® thermal platesetter at an energy of 600 mJ/cm$^2$, wavelength of 830 nm and resolution of 2400 dpi. After exposure the plate is washed with warm water to remove the unexposed area and mounted on an offset press (Ryobi 520). Good print results were obtained using standard inks and fountain solution. The same coating was also tested manually by heating a test strip to about 150° C. for a few seconds and measuring the contact angles with water droplets. In the unheated areas the contact angle was below 10° and in the heated areas it was about 90°. Further examination with an electronic microscope revealed that besides the chemical reaction there is also a small physical change in the surface. The unexposed surface has a more porous structure, while the heated area shows a slight evidence of melting. The slight melting can by no means explain the dramatic change in the contact angle, but it helps it as the more porous surface has a higher surface area and therefore a higher surface energy.

EXAMPLE 2A–2B

Same as example 1A–1B with the addition of 1 gram of polyvinyl butyral (14.3 grams of a 7% solution, material available from the Monsanto Corp., St Louis, Mo., type B72). Material is coated on non-lithographic aluminum, exposed under same conditions as in example 1A–1B and mounted on an offset press without washing off the unexposed area. The unexposed areas are now hydrophilic but do not dissolve easily. Good print results achieved with conventional (acid) fountain solution as well as plain water fountain solution without the unexposed areas washing off. Print results of example 2B (ADS830 absorber) are better than 2A (carbon absorber) mainly due to difficulty of uniformly dispersing the carbon particles.

EXAMPLE 3A–3B

Same as example 1A–1B, but the ratio of polyacrylic acid to silver behenate is changed to increase solubility of the unexposed areas. The ratio is:

4 grams silver behenate 2 grams polyacrylic acid 1 gram absorber 25 grams ethanol In this example the solubility of the unexposed area is greater than example 1A–1B, without significantly affecting the insolubility of the heated areas. The higher solubility enables the use of the press fountain solution to wash away the unheated areas, without requiring an intermediate step of washing. This allows the composition of example 3A–3B to be applied directly to a re-usable plate permanently mounted on press cylinder and imaging on press.

EXAMPLE 4

This is prepared in same manner as example 1A–1B but without using any solvent except water. The ratio is:

3 grams silver behenate 4 grams 25% solution of polyacrylic acid in water, molecular weight of about 240,000 (Goodrich K702)

1 gram Zeneca WS830 water soluble dye (from Zeneca Specialty Chemicals, UK)

30 grams water

This can be used as in example 1A–1B or with modified solubility as in examples 2A–2B and 3A–3B. The no solvent, all waterborne process, is important for environmental considerations as well as cost savings since a water solution of polyacrylic acid is significantly lower in cost than purified acid.

EXAMPLE 5

Same as example 4 except for sodium salt of polyacrylic acid (molecular weight about 5800) is used instead of polyacrylic acid.

EXAMPLE 6

Same as example 1A–1B and 2A–2B, with the addition of 0.1 grams of colloidal silica. Water receptivity and ease of coating are improved.

EXAMPLE 7

Same as example 1A–1B and 2A–2B, with the addition of a small amount of 3MFC125 (form 3M Corp., Minn., Minn.). Water receptivity is improved. This example shows the ability to add surfactants and other modifiers without affecting the basic reaction.

EXAMPLE 8

Same as examples 1A–1B and 2A–2B, with the additions of a small amount of Triton X100-100 surface active agent. Water receptivity is improved.

EXAMPLE 9

Same as example 1A–1B except iron stearate is used instead of silver behenate. Reaction is similar but performance is lower, with hydrophobic properties not as robust as achieved in example 1A–1B.

EXAMPLE 10

This example demonstrates the use of a water soluble polymer other than polyacrylic acid and a different silver salt. The ratio is:

3 grams Silver stearate (from Aveka Inc., Woodbury, Minn.)

14.3 grams Polyvinyl alcohol (in the form of 100 g of 7% solution, molecular weight about 100,000)

14 grams Water 0.2 grams Zeneca WS830 water soluble dye

Test results:

Contact angle in non-imaged area: 46°

Contact angle in imaged area: 103°

Good ink acceptance in imaged area and no ink acceptance in non-imaged areas

All other details are the same as example 1.

Having described the present invention, with reference to those specified embodiments, it is understood that numerous variations can be made without departing from the spirit of the invention and it is intended to encompass such reasonable variations or equivalents within its scope.

What is claimed is:

1. A laser imaged lithographic printing master comprising a hydrophilic dimensionally stable substrate coated with a single thin layer of a chemical composition capable of switching from a water washable state to an insoluble state when heated briefly, said composition forming the printing master and comprising:

(a) a water soluble polymer;

(b) a metallic salt of a fatty acid having a chain of between 10 to 30 carbon atoms; and (c) an absorber for absorbing radiation of a laser.

2. The invention in accordance with claim 1 wherein said single thin layer comprises a metallic salt of a fatty acid having a carbon chain length from about 18 to 24 carbon atoms and said single thin layer is a reactive layer.

3. The printing master of claim 1 wherein the water soluble polymer comprises polyacrylic acid.

4. The printing master of claim 3 wherein the metallic salt of a fatty acid is silver behenate.

5. The printing master of claim 1 wherein the water soluble polymer comprises polyvinyl alcohol.

6. The printing master of claim 5 wherein the metallic salt of a fatty acid is silver stearate.

7. The printing master of claim 1 wherein the metallic salt of a fatty acid is silver stearate.

8. The printing master of claim 1 wherein the hydrophilic dimensionally stable substrate is a lithographic metal.

9. The printing master of claim 8 wherein the dimensionally stable substrate is a printing cylinder.

10. A laser imaged lithographic printing master comprising a dimensionally stable substrate coated with a single thin layer of a chemical composition capable of switching from a hydrophilic state to a hydrophobic state when heated briefly to form the printing master, said composition comprising:

(a) a water soluble polymer;

(b) a metallic salt of a fatty acid having a chain of between 10 to 30 carbon atoms; and (c) an absorber for absorbing radiation of a laser.

11. The invention in accordance with claim 10 wherein said single thin layer comprises a metallic salt of a fatty acid having a carbon chain length from about 18 to 24 carbon atoms and said single thin layer is a reactive layer.

12. The printing master of claim 10 wherein the water soluble polymer comprises polyacrylic acid.

13. The printing master of claim 12 wherein the metallic salt of a fatty acid is silver behenate.

14. The printing master of claim 10 wherein the water soluble polymer comprises polyvinyl alcohol.

15. The printing master of claim 14 wherein the metallic salt of a fatty acid is silver stearate.

16. The printing master of claim 10 wherein the metallic salt of a fatty acid is silver stearate.

17. The printing master of claim 10 wherein the hydrophilic dimensionally stable substrate is a lithographic metal.

18. The printing master of claim 17 wherein the dimensionally stable substrate is a printing cylinder.

19. A laser imaged lithographic printing master comprising a hydrophilic dimensionally stable substrate coated with a single thin layer of a chemical composition capable of switching from a hydrophilic state to a hydrophobic state when heated briefly and without requiring a prior or subsequent exposure to energy to form the printing master, said composition comprising:

(a) a water soluble polymer;

(b) a metallic salt of a fatty acid having a chain of between 10 to 30 carbon atoms; and (c) an absorber for absorbing radiation of a laser.

20. The invention in accordance with claim 19 wherein said single thin layer comprises a metallic salt of a fatty acid having a carbon chain length from about 18 to 24carbon atoms and said single thin layer is a reactive layer.

21. The printing master of claim 19 wherein the water soluble polymer comprises polyacrylic acid.

22. The printing master of claim 21 wherein the metallic salt of a fatty acid is silver behenate.

23. The printing master of claim 19 wherein the water soluble polymer comprises polyvinyl alcohol.

24. The printing master of claim 23 wherein the metallic salt of a fatty acid is silver stearate.

25. The printing master of claim 19 wherein the metallic salt of a fatty acid is silver stearate.

26. The printing master of claim 19 wherein the hydrophilic dimensionally stable substrate is a lithographic metal.

27. The printing master of claim 26 wherein the dimensionally stable substrate is a printing cylinder.

* * * * *